US009167872B2

(12) United States Patent
Dobashi

(10) Patent No.: US 9,167,872 B2
(45) Date of Patent: Oct. 27, 2015

(54) ORNAMENT

(71) Applicant: Crossfor Co., Ltd., Yamanashi (JP)

(72) Inventor: Hidetaka Dobashi, Yamanashi (JP)

(73) Assignee: CROSSFOR CO., LTD., Yamanashi (JP)

( * ) Notice: Subject to any disclaimer, the term of this patent is extended or adjusted under 35 U.S.C. 154(b) by 0 days.

(21) Appl. No.: 14/230,332

(22) Filed: Mar. 31, 2014

(65) Prior Publication Data

US 2015/0075220 A1 Mar. 19, 2015

(30) Foreign Application Priority Data

Sep. 13, 2013 (JP) ..... 2013-190211

(51) Int. Cl.

| | |
|---|---|
| ***A44C 17/02*** | (2006.01) |
| ***A44C 17/00*** | (2006.01) |
| *A44C 9/00* | (2006.01) |
| *A44C 25/00* | (2006.01) |

(52) U.S. Cl.

CPC ..... *A44C 17/0258* (2013.01); *A44C 17/00* (2013.01); *A44C 17/0275* (2013.01); *A44C 9/00* (2013.01); *A44C 25/001* (2013.01)

(58) Field of Classification Search

CPC ..... A44C 17/0258; A44C 17/0266; A44C 17/0275; A44C 17/0283; A44C 17/0291

USPC ..... 63/26, 31

See application file for complete search history.

(56) References Cited

U.S. PATENT DOCUMENTS

| | | | |
|---|---|---|---|
| 2012/0151963 | A1 | 6/2012 | Dobashi |
| 2013/0239613 | A1 * | 9/2013 | Shah ..... 63/27 |

FOREIGN PATENT DOCUMENTS

| | | |
|---|---|---|
| JP | 07-16614 | 3/1995 |
| JP | 2007-61336 | 3/2007 |
| JP | 2007-061351 | 3/2007 |
| JP | 2007-195637 | 8/2007 |
| JP | 2008206532 | 9/2008 |
| JP | 2009-268573 | 11/2009 |
| JP | 2011-120770 | 6/2011 |
| JP | 2011-160927 | 8/2011 |
| JP | 3175111 | 4/2012 |
| JP | 2013-163039 | 8/2013 |
| WO | 03/077699 | 9/2003 |
| WO | 2010122637 | 10/2010 |
| WO | 2013011698 | 1/2013 |

OTHER PUBLICATIONS https://www.youtube.com/watch?v=O6d0vpsUkII Jun. 13, 2013, Rhythm of Love Collection: Diamonds & More Jewelry.* https://www.youtube.com/watch?v=UcKHF6-EFKU Rhythm of Love Diamond Pendant Giveaway Winner! Sep. 6, 2013.* https://www.youtube.com/watch?v=s5t6reQruCM Rhythm of Lover, Sep. 20, 2013.*

Japanese Office Action dated Oct. 29, 2013 in corresponding Japanese Patent Application No. 2013-190211 with English translation of Japanese Office Action.

Ostbye's Shimmering Diamonds Loop (new finding), https://www.youtube.com/watch?v=_7AOw_xZtLQ, Aug. 30, 2013.

* cited by examiner

*Primary Examiner* — Jack W Lavinder

(74) *Attorney, Agent, or Firm* — Young & Thompson

(57) ABSTRACT

The second ring 31 and the fourth ring 33 are fixed to the ouch 5 so that the table surface 7*a* (front, of the ornament unit) has a position that is directed upward by an angle alpha of about 5° to 45° with respect to the gravity direction. When it is in use condition. For example, it is achieved by twisting the first joint 61 and the second joint 63 by an angle corresponding to the angle alpha.

11 Claims, 6 Drawing Sheets

ORNAMENT

FIELD OF INVENTION

The present invention relates to the personal ornament with ornament unit that swings.

BACKGROUND

For example, there is a ring or the like that supports fixed gemstones, such as diamonds, to the support parts to become swingable. By swinging diamonds, it is possible to show more glitter of diamonds as compared with the case of not swinging.

There is a demand to enhance further decorative effect with ornament unit swingable supported in a pendant and a like.

SUMMARY OF THE INVENTION

The present invention has been made in view of such circumstances, its object is to provide the personal ornament that enhances its decorative effect in an ornament unit that swings.

In order to solve the problems occurring in the prior art described above and achieve the above object, a personal ornament of the present invention which is hanging to a predetermined position of the user or a predetermined component the user to wear, comprising;

a holder to hold an ornament unit;

a frame which is hanging to the predetermined point or the predetermined component;

a first member having a circle or arc-shaped first bending unit which is fixed to the frame;

a second member having a circle or arc-shaped second bending unit which is fixed on the holder and which engages with the first bending unit in a state that can swing by contacting inner circumferences of the first bending trait and the second bending unit at the first contact point;

a third member having a circle or arc-shaped third bending unit which is fixed to the frame with a predetermined distance to the first member at the same position with the first member along gravity direction in a state the frame is hanging; and a fourth member having a circle or arc-shaped fourth bending unit which is fixed to the holder with a predetermined distance to the second member at the same position with the second member along the gravity direction and which engages with the third member in a state that can swing by contacting inner circumferences of the third bending unit and the fourth bending unit at the second contact point, wherein the second member and the fourth member are fixed on the holder so that a front surface of the ornament unit has a posture which faces upper direction by approximately 3 to 45 degree with respect to the gravity direction, and the first contact point and the second contact point are positioned at the upper position in the gravity direction with respect to overall center of gravity of the ornament unit and holder in a state that, external force is not applied to the ornament unit and the holder while being hanging,

THE PREFERRED EMBODIMENT OF THIS INVENTION

Hereinafter, the embodiment of the personal ornament in the present invention will be explained.

First Embodiment

Figure 1:
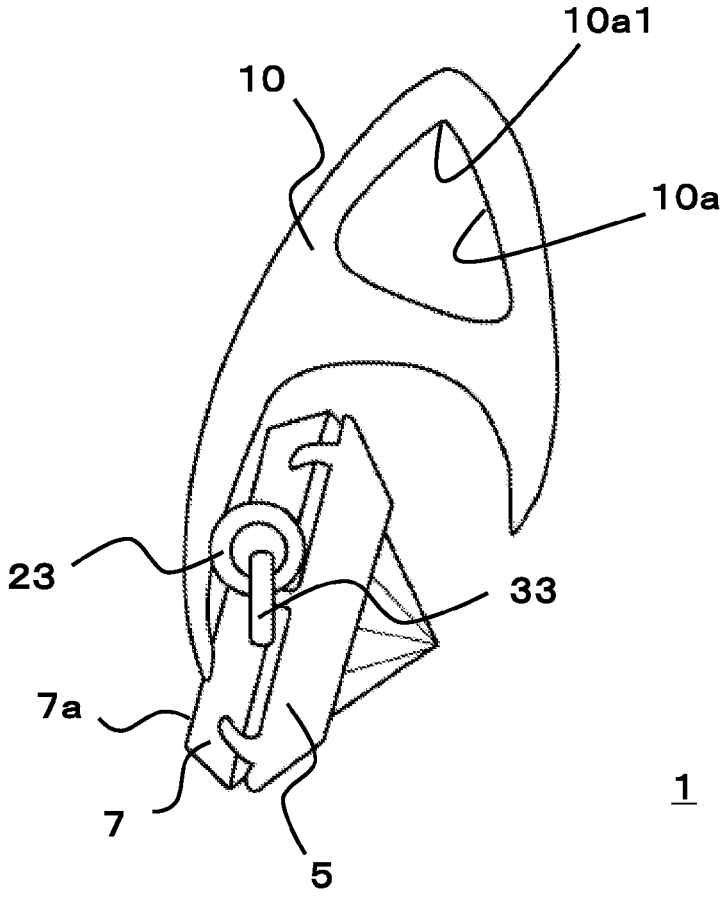
FIG. 1 is a side view of the pendant 1 in the state of not swinging of the embodiments of the present invention.
Figure 2:
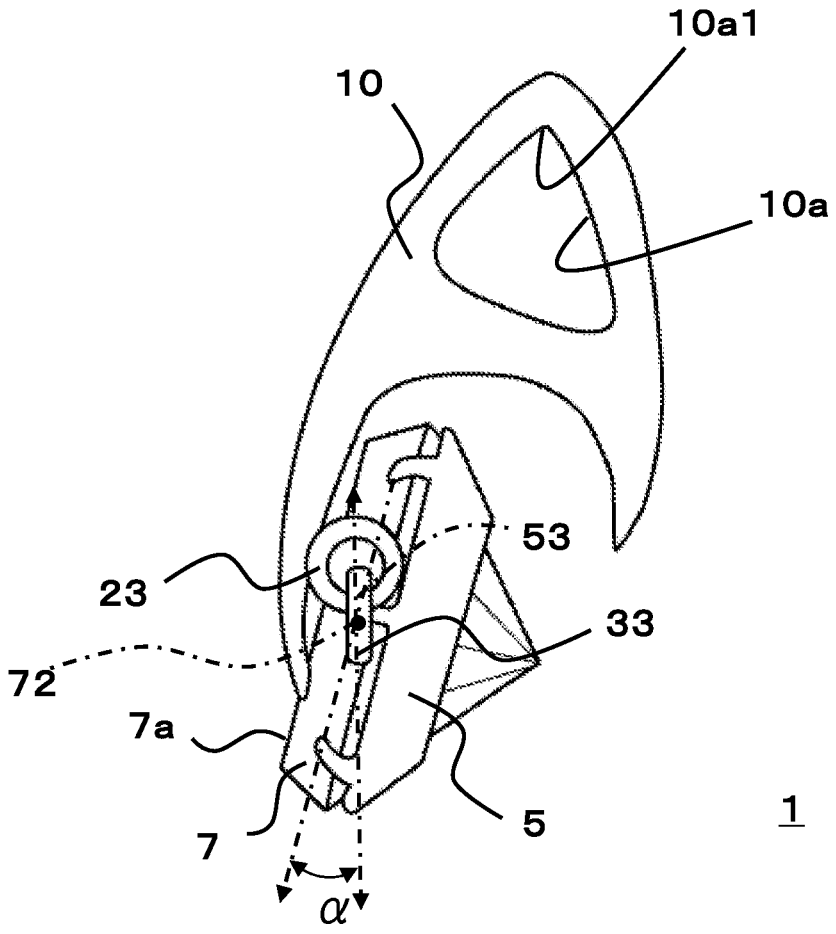
FIG. 2 is a view to explain the pendant 1 shown in the FIG. 1.
Figure 3:
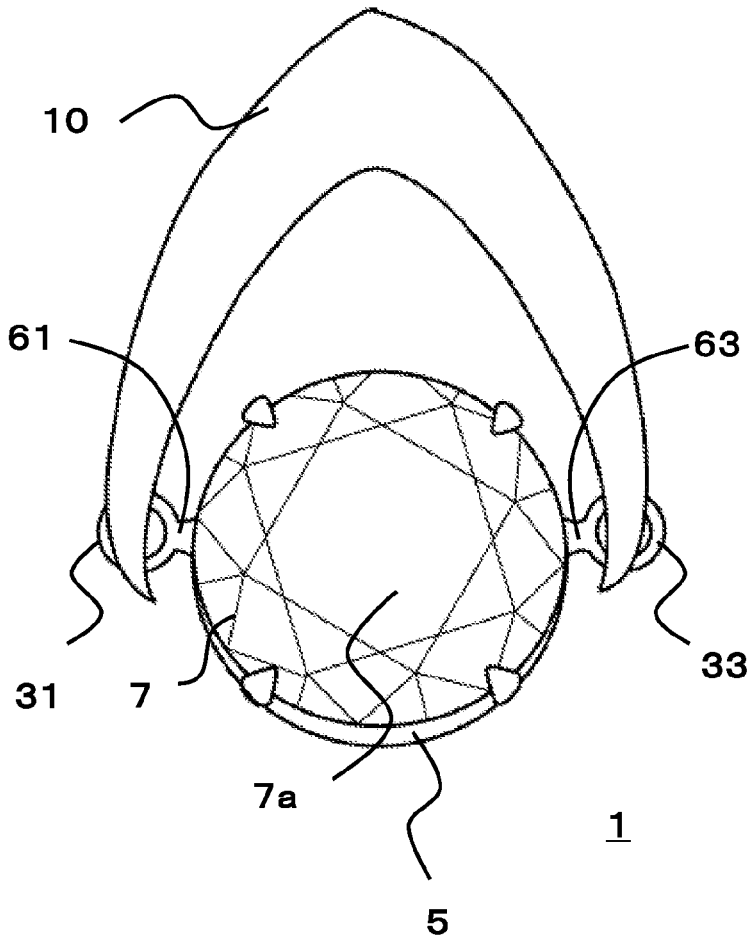
FIG. 3 is a front view of the pendant 1.
Figure 4:
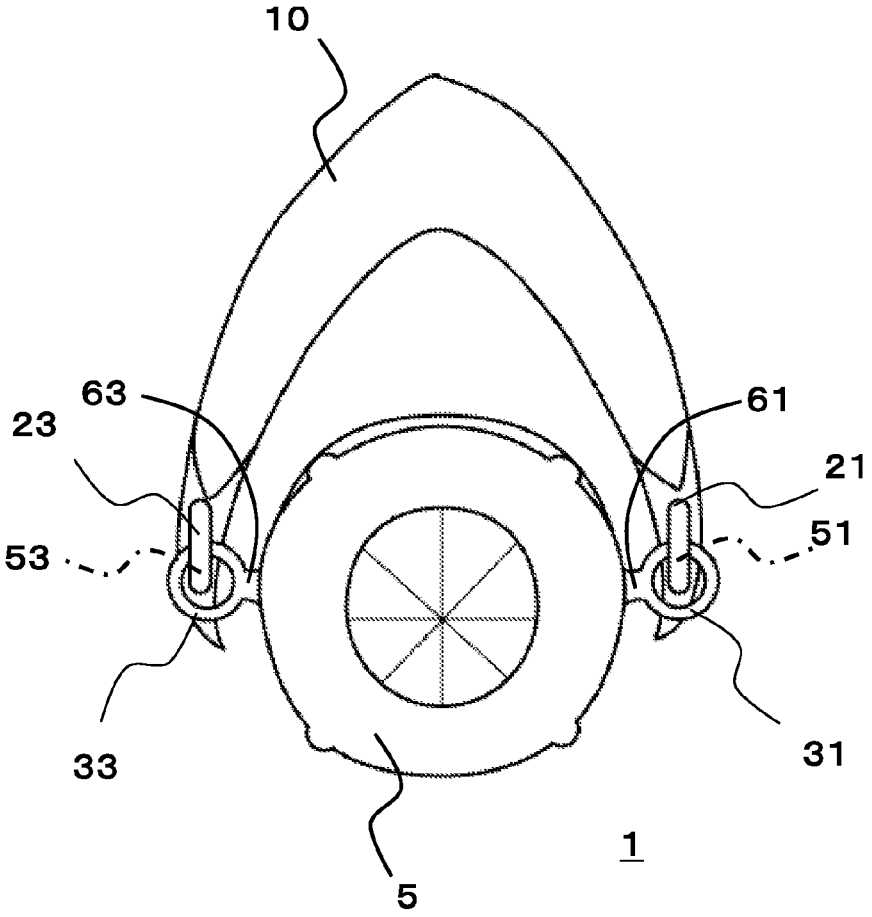
FIG. 4 is a rear view of the pendant 1.
Figure 5A:
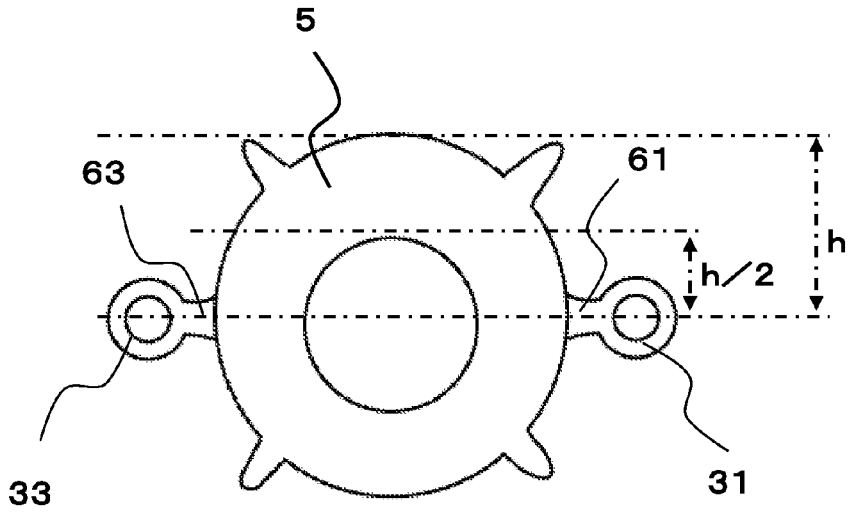
FIG. 5A is a front view of the holder 5 in the state that a diamond is not mounted.
Figure 5B:
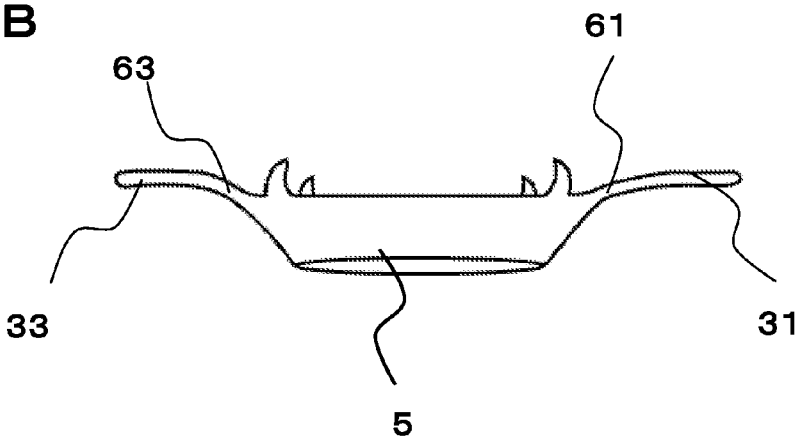
FIG. 5B is a bottom plan view of the holder 5.

FIG. 1 is a side view of the pendant 1 in the state of not swinging of the embodiments of the present invention. FIG. 2 is a view to explain the pendant 1 shown in the FIG. 1. FIG. 3 is a front view of the pendant 1. FIG. 4 is a rear view of the pendant 1. FIG. 5A is a front view of the holder 5 in the state that a diamond is not mounted, and FIG. 5B is a bottom plan view of the holder 5.

FIGS. 1-4 indicate in the state that the frame 10 is used hanging a string-like parts (not shown) to the neck of the user. At this time, the string-like parts engage to the engage point 10*a*1 of the opening 10*a*.

As shown in FIGS. 1 to 4, the pendant 1 has a structure that the holder 5 is set to the frame 10 in state of swingable.

The diamond 7 is fixed to the holder 5.

The holder 5 fixes the diamond 7 by nail to expose to outwards the table surface 7*a* of the diamond 7 and the pavilion section.

The first ring 21 (the first member) is fixed to the frame 10. Further, the first ring 21 may be formed integrally with the frame 10.

The second ring 31 (the second member) is fixed to the holder 5. Further, the second ring 31 may be formed integrally with the holder 5.

Inner peripheral portions of the first ring 21 and the second ring 31 are joined swingable (inner peripheral portions of both the first bending unit and the second bending unit) at the first contact point 51.

The third ring 23 (the third member) is fixed to the frame 10. Further, the third ring 23 may be formed integrally with the frame 10.

The fourth ring 33 (the forth member) is fixed to the holder 5. Further, the fourth ring 33 may be formed integrally with the holder 5.

Inner peripheral portions of the third ring 23 and the fourth ring 33 are engaged swingable (inner peripheral portions of both the third bending unit and fourth bending unit) at the second contact point 53.

As shown in FIG. 4, the first ring 21 and the third ring 23 are placed in aforementioned use condition, in approximately same position (vertical, direction in the figure) in the gravity direction.

The second ring 31 and the fourth ring 33 are placed in approximately same position in the aforementioned gravitational direction.

As shown in FIG. 4, the opening of the first ring 21 and the opening of the third ring 23 are positioned towards a girdle of the diamond 7.

The opening of the second ring 31 and the opening of the fourth ring 33 are positioned toward approximately the front of the user.

As shown in FIG. 2, the second ring 31 and the fourth ring 33 is fixed to the holder 5 so that the table surface 7*a* is directed upward by an angle α of about 5° to 45° with respect to the gravity direction, in aforementioned use condition and in a state in which external force is not applied to the holder 5 and diamond 7.

The predetermined range of the angle α is determined as optimal, based on inclination angle of the breast on a woman, and the angle of the eyes of the viewer located in the front. For example, the angle α is 15 degree.

Here, the "front side of the ornament unit" of the present invention indicates the side of the ornament unit to be look better by spectator, there is no need to be plan in particular.

When the pendant 1 is worn, the frame 10 is inclined upward by swelling of a women's breast. In the present embodiment, the table surface 7*a* had an angle α as described above. Therefore, when seen from the position of the eyes of person in the front, eye position and the table surface 7*a* of the diamond, 7 to be substantially orthogonal, that enhances aesthetic sense.

In addition, the posture of the frame 10 and the table surface 7*a* of the diamond 7 are able to be coinciding, and the diamond 7 can be seen more beautiful.

As shown in FIG. 2, the first ring 21 and the third ring 23 is fixed to the holder 5 so that the first contact point 51 and the second contact point 53 is positioned upper with respect to overall the center of gravity 72 of the holder 5 and the diamond 7 in the gravity direction in the use condition that does not swing.

Thus, the table surface 7*a* is able to be held in stable posture towards the front side of the user.

Furthermore, as shown in FIG. 2, in the aforementioned use condition and in a state where the external force is not applied to the holder 5 and the diamond 7, in the plane direction perpendicular to the line connecting the first contact point 51 and the second contact point 53, there are the first contact point 51 and the second contact point 53 in the gravity direction with respect to the center of gravity of the entire of the holder 5 and the diamond 7.

Further, for example, in a state in which an external force is applied to table surface 7*a* to be parallel to the gravity direction, the center of gravity 72 is located on the back side of the diamond 7 with respect to the first contact point 51 and the second contact point 53.

For example, it is realized by twisting the first joint 61 and the second joint 63 in FIGS. 3 to 5 by an angle corresponding to the angle α.

Thus, the table surface 7*a* can be tilted by an angle α as mentioned above, the holder 5 is able to swing in a short period with small amplitude around the first contact point (the second contact point). Therefore high spectacle can be obtained.

In addition, it is possible to take sufficient distance between the swinging holder 5, the diamond 7 and the frame 10.

Note that, the center of gravity 72 may be located on the back side of the diamond 7 against the first contact point 51 and the second contact point 53 by the way other than twisting the first joint 61 and the second joint 63 described above.

For example, the first joint 61 may be bent so that a part of the first joint 61 which is placed at the second ring 31 side is placed on the front side of the diamond 7 with respect to the holder 5.

In this case, the second joint 63 is bent so that a part of the second joint 63 which is placed at the fourth ring 33 is placed on the front side of the diamond 7 with respect to the holder 5.

However, the method of twisting the first joint 61 and the second joint 63 as mentioned above is easy to manufacture compared to other methods. Further, since the external force in the direction of twisting does not occur in normal use, the positional relationship between the first contact point 51, the second contact point 53 and the center of gravity 72 becomes hardly shifted. Further, it is also possible to impart high strength.

Further, in the pendant 1, the first contact point 51 and the second contact point 53 are located in the region which the diamond 7 positioned in the plane direction perpendicular to the line connecting the first contact point 51 and the second contact point 53.

At this time, considering the swing characteristics, it is desired that the first contact point 51 and the second contact point 53 are positioned, as shown in FIG. 5, in the range of the distance X ($0<X<\frac{1}{2}h$) that upward from the center of the ouch 5 at the gravity direction (the vertical direction in the figure), when the distance between the center of the holder 5 and the end of the holder 5 defined as "h".

By using such a configuration, when seen from the front side of the user, the line connecting the first contact point 51 and the second contact point 53 is located in the table surface 7*a* of the diamond 7, the diamond 7 is able to swing around the line. Herewith, a glitter of diamonds of the diamond 7 can be increased by swinging, therefore high spectacle can be obtained.

In addition, the first contact point 51 and the second contact point 53 are placed at a position shifted from the center of the diamond 7 in the vertical direction mentioned above.

Thereby, the line connects the first contact point 51 and the second contact point 53 is off from center position of the front side of the diamond 7 which is a vertically and horizontally symmetrical pattern as described above, therefore asymmetric brightness pattern, can be made. Herewith, a glitter of diamonds of the diamond 7 can be in various ways by swinging, high spectacle can be obtained.

In addition, as shown in FIG. 1 and FIG. 2, the first contact point 53 and the second contact point 53 are placed on the front side with, respect to the center position of the side surface of the diamond 7 by seeing from the side direction. Thus, it is possible to shorten the distance between the table surface 7*a* of the diamond 7 and the center of swinging, and the table surface 7*a* (front side) can be swung over, as a result, high aesthetics can be obtained.

As shown in FIG. 1 and FIG. 2, when seen from the side, the first contact point 51 and the second contact point 53 are located on the front side with respect to the engage point 10*a*1 which a string-like part is in contact with.

Accordingly, the space for the holder 5 to swing is easy to make at the front side and opposite side (user side) of the holder 5.

Further, in the pendant 1, the swinging of the first ring 21 and the second ring 31 and the swinging of the third ring 23 and fourth ring 33 are not completely synchronized, and shift delicately. Accordingly, the swing pattern on the both sides of the table surface 7*a* of the diamond 7 become slightly different, thereby, a glitter of the diamond 7 can be increased.

Second Embodiment

Figure 6:
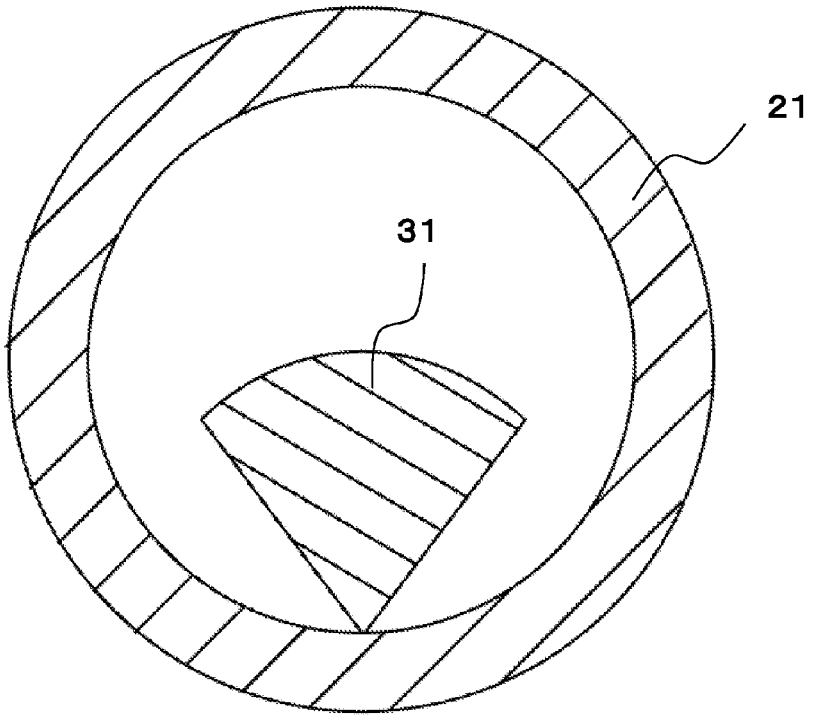
FIG. 6 is a view to explain the pendant 1 of the second embodiment.

In the present embodiment, as shown in FIG. 6, the cross-section of the first ring 21, the second ring 31, the third ring 23 and the fourth ring 33 are tapered towards the inner peripheral portion.

The either cross-sectional of the first ring 21 or the second ring 31 which engages together may be in the shape tapered toward the circumference.

Moreover, the either cross-sectional of the third ring 23 or the fourth ring 33 which engages together may be in the shape tapered toward the circumference.

In addition, instead of the entire inner periphery of each ring, but it may be in the shape tapered only the peripheral portion of a portion that engages with the rings forming a pair.

According to the pendant 1 of the present embodiment, by setting a shape of a cross-section of the ring to be tapered as described above, the contacting area between the rings can be reduced and the fractional resistance of the swinging can be reduced. Herewith, it becomes possible to swing in conjunction with the subtle movement of the user. Further, it is possible to increase the swinging time.

The present invention is not limited to aforementioned embodiments.

Namely, within the technical scope of the present invention or the equivalent scope, person skilled in art may be subjected to various modifications, combinations, sub-combinations, and alternative regarding the constituent elements of the aforementioned embodiments.

A pendant has exemplified as the personal ornament in the embodiment described above, but the present invention can be applied to another type of personal ornaments used at a predetermined position of the user (For instance, ear), or predetermined components that the user wears by hanging.

Furthermore, in the aforementioned embodiment, a ring-shaped object is exemplified as members 1-4 of the present embodiment. However, if the member is arc-shaped bending unit, the shape is not limited.

Further, in the aforementioned embodiment, a case of supporting one jewel at the inside of the frame is exemplified, but several jewels can be supported too. Furthermore, several types of jewels can be hold onto the one frame.

The shape of the frame is optional, the frame may possess the opening part with closed rings and such, and may be attached swinging jewels inside of the opening.

Moreover, in aforementioned embodiment, diamonds are illustrated as ornament, however, synthetic and artificial gemstones other than, diamonds can be used.

In aforementioned embodiment, the ring is illustrated as members 1-4 of the present embodiment. However, if the bending unit is possessed and the inner peripheral portions of the both bending unit are able to engage, the shape is not particularly limited to.

INDUSTRIAL APPLICABILITY

The present invention is applicable to the personal ornament.

EXPLANATIONS OF LETTERS OR NUMERALS

1 . . . pendant 1
5 . . . holder 5
7 . . . diamond 7
7*a* . . . table surface 7*a*
10 . . . frame 10
10*a*1 . . . engage point 10*a*1
21 . . . first ring 21
23 . . . third ring 23
31 . . . second ring 31
33 . . . fourth ring 33
61 . . . first joint 61
63 . . . second joint 63
72 . . . center of gravity 72

The invention claimed is:

1. A personal ornament which is configured to be worn about a neck of a user, the personal ornament comprising:

a holder configured to hold an ornament unit, the holder having first and second sides, the ornament unit being disposed between the first and second sides of the holder;

a frame attached to the holder, the ornament unit of the holder being disposed between two end portions of the frame having a predetermined distance therebetween;

a first member having a circle or arc-shaped first bending unit which is fixed to the frame at a first end portion of the frame;

a second member having a circle or arc-shaped second bending unit, which is fixed on the holder at the first side of the holder, and engages with the first member in a state that the second member is configured to swing by contacting inner circumferences of the first bending unit and the second bending unit at a first contact point;

a third member having a circle or arc-shaped third bending unit which is fixed to the frame at a second end portion of the frame at a same position at the second end portion of the frame as the position of the first member at the first end portion of the frame; and a fourth member having a circle or arc-shaped fourth bending unit which is fixed to the holder at the second side of the holder, and which engages with the third member in a state that the fourth member is configured to swing by contacting inner circumferences of the third bending unit and the fourth bending unit at a second contact point, wherein the first contact point and the second contact point are positioned in a distance range X of the holder, where the distance range X is defined by $0<X<h/2$, where h is the distance between the center of the holder and the end of the holder, and the position of the first contact point and the second contact point in relation to the end of the holder results in an inclination angle of an entire table surface of the ornament unit by approximately 5 to 45 degrees with respect to a first plane defined along the perimeter of the second member and a second plane defined along the perimeter of the fourth member.

2. The personal ornament as set forth in claim 1, wherein the first contact point and the second contact point are located at a table surface portion of the ornament unit, disposed away from the table surface in a plane direction perpendicular to a line connecting the first contact point and the second contact point.

3. The personal ornament as set forth in claim 1, wherein the first contact point and the second contact point are in the vertical direction with respect to the overall center of gravity of the ornament unit and the holder, in a plane direction perpendicular to a line connecting the first contact point and the second contact point in the state that the external non-gravity force is not applied to the ornament unit and the holder while worn by the user.

4. The personal ornament as set forth in claim 3, wherein in a state in which the non-gravity external force is applied to the ornament unit so that a table surface side of the ornament unit is parallel to the vertical direction, the overall center of gravity of the ornament unit and the holder is on the side opposite the table surface side of the ornament unit with respect to the first contact point and the second contact point.

5. The personal ornament as set forth in claim 4, further comprising:

a first joint interposed between the second member and the holder, the first joint being bent, and a second joint interposed between the fourth member and the holder, the second joint being bent, wherein the bending of the first joint causes a second member side portion of the first joint to be positioned on the table surface side of the ornament unit against a side of the holder, and the bending of the second joint causes a fourth member side portion of the second joint to be positioned on the table surface side of the ornament unit against a side of the holder in a state in which the non-gravity external force is applied to the table surface side of the ornament unit to be parallel to the vertical direction.

6. The personal ornament as set forth in claim 1, further comprising:

a first joint interposed between the second member and the holder, the first joint being angled between the second member and the holder, and a second joint interposed between the fourth member and the holder, the second joint being angled in relation to the fourth member and the holder, wherein an angle of the first joint and an angle of the second joint result in the overall center of gravity of the ornament unit and the holder to be on a side opposite a table surface side of the ornament unit away from the first contact point and the second contact point in a state in which the non-gravity external force is applied to the table surface side of the ornament unit to be parallel to the vertical direction.

7. The personal ornament as set forth in claim 1, wherein one or more of a cross-section of the first bending unit and the second bending unit has a tapered shape towards an inner peripheral portion of the ornament, and one or more of a cross-section of the third bending unit and the fourth bending unit has a tapered shape towards the inner peripheral portion.

8. The personal ornament as set forth in claim 1, wherein the first, second, third, and fourth members are ring-shaped and each include an opening therethrough, the opening of the first member and the opening of the third member are positioned substantially toward a side surface of the ornament unit, and the opening of the second member and the opening of the fourth member are positioned substantially away from a table surface side of the ornament unit.

9. The personal ornament as set forth in claim 1, wherein the first contact point and the second contact point are disposed in a region of the personal ornament in which the ornament unit is positioned in a plane direction perpendicular to a line connecting the first contact point and the second contact point.

10. The personal ornament as set forth in claim 1, wherein the angle of the first joint and the angle of the second joint each correspond to an angle of inclination of the entire table surface of the ornament unit with respect to the vertical direction.

11. A personal ornament which is configured to be worn about a neck of a user, the personal ornament comprising:

a holder configured to hold an ornament unit, the holder having first and second sides, the holder being configured to receive the ornament unit between the first and second sides of the holder;

a frame attached to the holder, the frame having two end portions of the frame having a predetermined distance therebetween, the frame being configured to receive the ornament unit between the two end portions;

a first member having a circle or arc-shaped first bending unit which is fixed to the frame at a first end portion of the frame;

a second member having a circle or arc-shaped second bending unit, which is fixed on the holder at the first side of the holder, and engages with the first member in a state that the second member is configured to swing by contacting inner circumferences of the first bending unit and the second bending unit at a first contact point;

a third member having a circle or arc-shaped third bending unit which is fixed to the frame at a second end portion of the frame at a same position at the second end portion of the frame as the position of the first member at the first end portion of the frame; and a fourth member having a circle or arc-shaped fourth bending unit which is fixed to the holder at the second side of the holder, and which engages with the third member in a state that the fourth member is configured to swing by contacting inner circumferences of the third bending unit and the fourth bending unit at a second contact point, wherein the first contact point and the second contact point are positioned in a distance range X of the holder, where the distance range X is defined by $0<X<h/2$, where h is the distance between the center of the holder and the end of the holder, and the position of the first contact point and the second contact point in relation to the end of the holder results in an inclination angle of approximately 5 to 45 degrees of a holder plane passing through the perimeter of the holder, with respect to a first plane defined along the perimeter of the second member and a second plane defined along the perimeter of the fourth member.

* * * * *